United States Patent [19]

Tadokoro et al.

[11] Patent Number: 4,612,904

[45] Date of Patent: Sep. 23, 1986

[54] FUEL INJECTION SYSTEM FOR INTERNAL COMBUSTION ENGINES

[75] Inventors: Tomoo Tadokoro; Haruo Okimoto, both of Hiroshima, Japan

[73] Assignee: Mazda Motor Corporation, Hiroshima, Japan

[21] Appl. No.: 579,962

[22] Filed: Feb. 14, 1984

[30] Foreign Application Priority Data

Feb. 15, 1983 [JP] Japan ..... 58-24445
Nov. 8, 1983 [JP] Japan ..... 58-209648

[51] Int. Cl.[4] ..... F02M 39/00

[52] U.S. Cl. ..... 123/492; 123/585; 123/179 L

[58] Field of Search ..... 123/585, 586, 587, 588, 123/589; 179 L, 179 G, 492, 491, 472, 470

[56] References Cited

U.S. PATENT DOCUMENTS 3,494,340 2/1970 Weber ..... 123/179 L
4,157,084 6/1979 Wallis ..... 123/179 L
4,364,349 12/1982 Miyagi ..... 123/491
4,418,674 12/1983 Hasegawa ..... 123/179 L
4,445,483 5/1984 Hasegawa ..... 123/492

FOREIGN PATENT DOCUMENTS 53-43616 11/1978 Japan ..... 123/492
54-53718 4/1979 Japan ..... 123/492
57-52378 11/1982 Japan ..... 123/492
2005348 4/1979 United Kingdom ..... 123/492

*Primary Examiner*—Carl Stuart Miller
*Attorney, Agent, or Firm*—Fleit, Jacobson, Cohn & Price

[57] ABSTRACT

A fuel injection device for internal combustion engines, provided with a light load fuel injection valve and a heavy load injection valve for each cylinder of the engine. The light load fuel injection valve and the heavy load fuel injection valve are provided in an intake passage. The light load fuel injection valve is positioned close to the combustion chamber of the engine whereas the heavy load fuel injection valve is located further from the combustion chamber than the light load fuel injection valve. The fuel injection device is also provided with a control circuit which controls the light load fuel injection valve to provide additional supply of fuel during engine accelerating operation so that the increased fuel is rapidly introduced into the combustion chamber at the time of engine acceleration.

19 Claims, 11 Drawing Figures

FUEL INJECTION SYSTEM FOR INTERNAL COMBUSTION ENGINES

The present invention relates to a fuel supply system for internal combustion engines, and more particularly to a fuel injection type fuel supply system for internal combustion engines provided with at least two fuel injection means for each combustion chamber of the engine.

A fuel injection type fuel supply system is in general provided with a fuel injection means, such as a fuel injection valve, in an intake passage. A control circuit is provided for controlling the timing and duration of the opening of the fuel injection valve by a pulse signal applied from a control circuit in accordance with the operating condition of the engine, thereby to control the amount of fuel to be injected. Such a known fuel injection system is however disadvantageous in that where the amount of fuel injected is controlled by only one fuel injection valve throughout the engine operation zone, the fuel injection valve must have an injecting nozzle opening which is large enough to make it possible to supply a sufficient quantity of fuel for heavy load engine operations. Where the fuel injection valve is formed with such a large nozzle opening, it becomes difficult to accomplish a precise control of fuel supply under a light load engine operation wherein the quantity of fuel supply is very small.

It has therefore been proposed, for example, in Japanese patent publication No. 53-43616 and Japanese patent public disclosure No. 54-53718, to provide two fuel injection valves for a single combustion chamber. According to the proposals, one of the fuel injection valves is used throughout the engine operating range whereas the other fuel injection valve is operated under a heavy load range. Thus, it becomes possible to supply a sufficient quantity of fuel for heavy load engine operation by the two fuel injection valves without increasing the valve opening area of a single valve. These proposals will therefore ensure accuracy of the control of fuel injection under light load engine operation.

As an alternative, in Japanese utility model disclosure No. 57-26665, there is proposed to provide an engine intake passage with two fuel injection valves, one upstream of and the other downstream of the throttle valve, the fuel injection valve downstream of the throttle valve is used in light load engine operations and possibly throughout the engine operation, whereas the fuel injection valve upstream of the throttle valve is used only in heavy load engine operations. The proposed system is described as accomplishing a satisfactory fuel atomization throughout the engine operation.

It should however be noted that in the proposed fuel injection systems described above, no special measures are provided for acceleration of the engine, and no special considerations are made to the mounting positions of the fuel injection valves. Therefore, such systems have not been able to provide a satisfactory response in acceleration and deceleration. Such response characteristics may be improved by locating the fuel injection valve close to the combustion chamber, however, such an arrangement will produce a further problem because there will be no adequate passage distance for providing satisfactory fuel atomization and mixing between the fuel and the air.

It is therefore an object of the present invention to provide a fuel injection system for internal combustion engines which can improve response characteristics of the engine in acceleration and deceleration.

Another object of the present invention is to provide a fuel injection system in which fuel atomization and mixing between fuel and air can be improved.

A further object of the present invention is to provide an engine intake system having fuel injection valves which are controlled to provide an improved fuel supply in acceleration.

According to the present invention, the above and other objects can be accomplished by a fuel injection system for an engine having combustion chamber means and intake passage means leading to said combustion chamber means, said fuel injection system comprising first and second fuel injection valve means located in said intake passage means and spaced apart from each other in a longitudinal direction of said intake passage means so that one of said fuel injection valve means is closer to said combustion chamber means than the other, control means for controlling said first and second fuel injection valve means so that said first fuel injection valve means is actuated to inject fuel into said intake passage means at least under light load engine operation and said second fuel injection valve means is actuated to inject fuel into said intake passage means under a heavy load engine operation, said control means including means for actuating said fuel injection valve means closer to said combustion chamber means in acceleration so that an additional supply of fuel is provided from said fuel injection valve means closer to said combustion chamber means. The first fuel injection valve means may be operated throughout the engine operating range including light load engine operation to heavy load engine operation. The first fuel injection valve means may also be located downstream of the second injection valve means.

In another aspect of the present invention, there is provided a fuel injection system for an internal combustion engine having at least one combustion chamber and a plurality of intake passages leading to said combustion chamber, said fuel injection system comprising first fuel injection valve means provided in one of said plurality of intake passages, second fuel injection valve means provided on the other of said plurality of intake passages, said first fuel injection valve means being located close to said combustion chamber, said second fuel injection valve means being located further from said combustion chamber than said first fuel injection valve means, control means for controlling said first and second fuel injection valve means so that said first fuel injection valve means is actuated to inject fuel throughout the engine operating range and said second fuel injection valve means is actuated to inject fuel in the heavy load engine operation zone, said control means further having compensation means for controlling said first fuel injection valve means to provide an additional supply of fuel during engine acceleration. The control means may be of the type which controls the first and second fuel injection valve means so that the first and second valve means periodically inject fuel in synchronization with the rotation of the engine. The compensation means may be of the type which controls the first fuel injection valve means so that the first valve means injects fuel asynchronously with the rotation of the engine so as to increase the amount of fuel injected thereby during engine acceleration.

The above and other objects and features of the present invention will become apparent from the following descriptions of preferred embodiments with reference to the accompanying drawings, in which.

Figure 1:
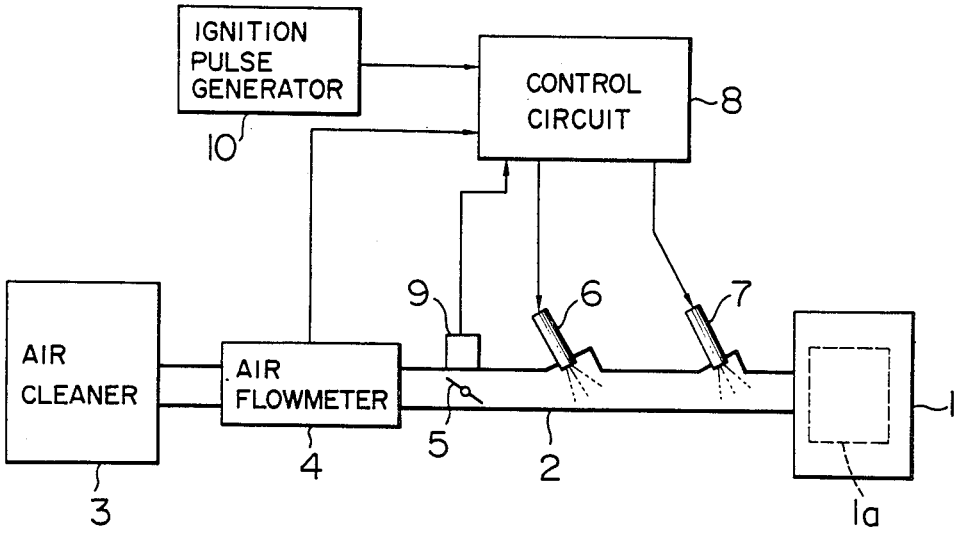
FIG. 1 is a diagrammatical view of a fuel injection system for an engine in accordance with a first embodiment of the present invention.

Referring now to the drawings, particularly to FIG. 1, there is shown an engine 1 having a combustion chamber 1*a* and an intake passage 2 leading to the combustion chamber 1*a*. The intake passage 2 is provided with an air cleaner 3, an air flowmeter 4 and a throttle valve 5 which are arranged in this order from the upstream end. Downstream of the throttle valve 5, there are a second fuel injection valve 6 and a first fuel injection valve 7 which are arranged in this order from the upstream side of the intake passage 2. The first and second fuel injection valves 7 and 6 are associated with a control circuit 8 which may be a microcomputer.

The control circuit 8 is connected with the air flowmeter 4 to receive an airflow signal therefrom. There are also provided a load sensor 9 which senses engine load by detecting the degree of the opening of the throttle valve 5, and an ignition pulse generator 10 which are also connected with the control circuit 8. The control circuit 8 receives inputs from the air flowmeter 4, the load sensor 9, and the ignition pulse generator 10 which produce signals representing engine operating conditions and carries out a calculation to determine the amount of fuel to be supplied to the engine 1. The control circuit produces driving pulses for controlling the first and second fuel injection valves 7 and 6 in accordance with the results of the calculation.

Figure 2:
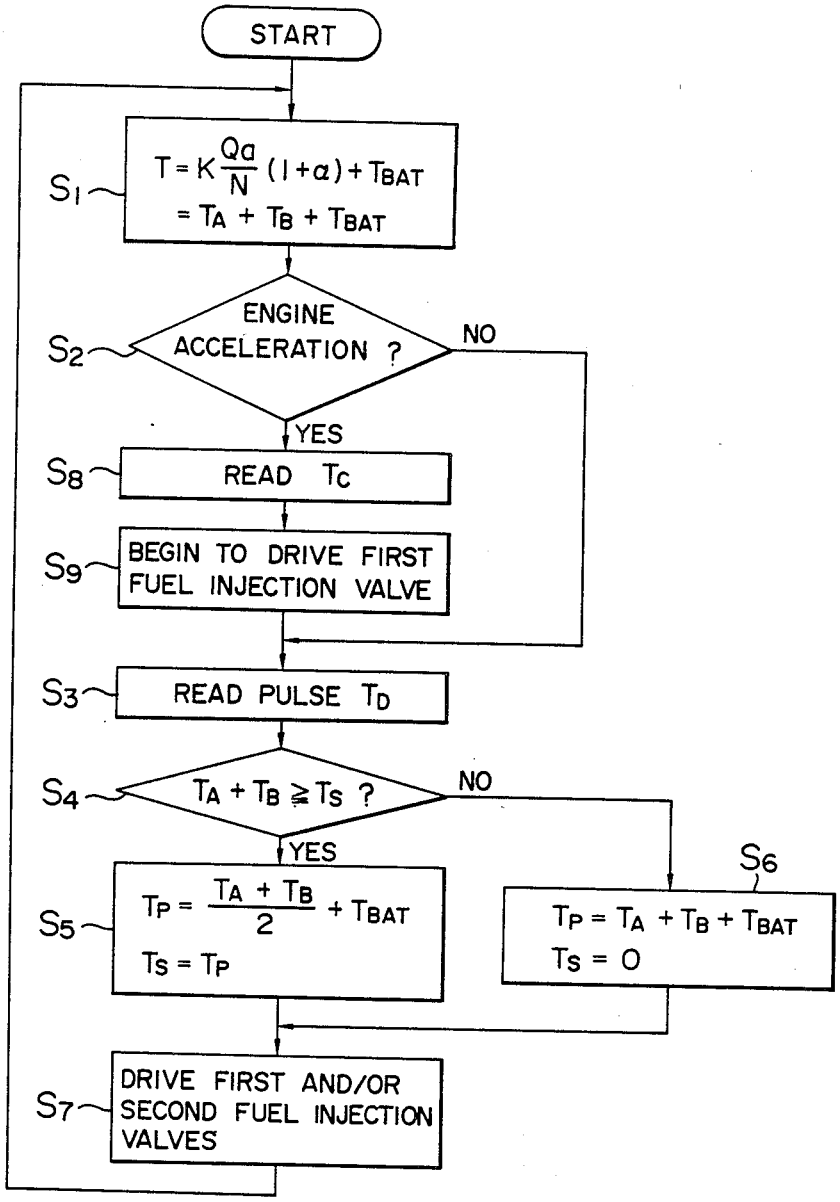
FIG. 2 is a flow chart showing one example of the fuel injection operations.

In accordance with a program shown in FIG. 2 which can be adopted in the present invention, the control circuit 8 first of all calculates in a first step $S_1$ the duration T of the driving pulse according to the formula $$T = K\frac{Qa}{N}(1 + \alpha) + T_{BAT}$$

wherein Qa is the flow rate of the intake air, N is the rotating speed of the engine, K is a constant, $\alpha$ is a compensation factor required for compensating for the temperature of the engine and that of the intake air, the engine load, etc., and $T_{BAT}$ is the ineffective part of the driving pulse which corresponds to the time lag between the application of the driving pulse and the opening of the fuel injection valve. The duration T of the driving pulse may be considered as comprising time $T_A$ which corresponds to the basic driving time added with any compensation factor other than the compensation for acceleration, an additional time $T_B$ corresponding to the acceleration compensation and the ineffective part $T_{BAT}$ of the driving pulse.

Figure 3:
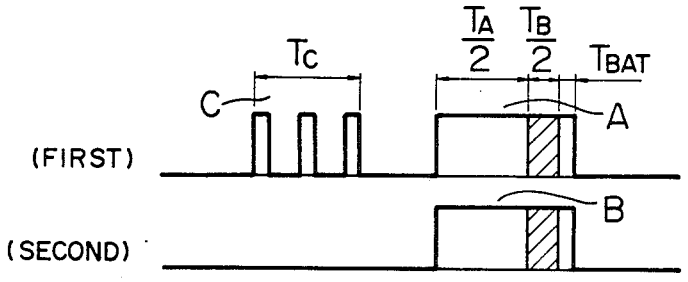
FIG. 3 is a chart showing one example of fuel injection pulses.

In a second step $S_2$, a judgement is made as to whether the actual demand for acceleration of the engine is higher than a predetermined value. When the actual accelerating rate is not higher than the predetermined value, a dividing pulse $T_D$ of a predetermined value is read. Then, the valve driving pulses $T_P$ and $T_S$ are calculated. This calculation is carried out by dividing in a fourth step $S_4$, the sum of the time $T_A$ and the time $T_B$ is compared with the pulse $T_D$. When the sum of the time intervals $T_A$ and $T_B$ is larger than the width $T_D$, the sum of the times $T_A$ and $T_B$ into half and adding the resultant value with the ineffective width $T_{BAT}$ (fifth step $S_5$). The valve driving pulses $T_P$ and $T_S$ are then applied to the first and second fuel injection valves 7 and 6, respectively, in a synchronized relationship with the rotation of the engine as denoted by "A", "B" in FIG. 3. On the other hand, when the sum of the times $T_A$ and $T_B$ is not larger than the width $T_D$, a sixth step $S_6$ is carried out. In the sixth step $S_6$, the valve driving pulse $T_P$ which is to be applied to the first fuel injection the valve which is obtained by adding the valve is calculated by adding the sum of the time intervals $T_A$ and $T_B$ with the ineffective width $T_{BAT}$. In this instance, no driving pulse is applied to the second fuel injection valve 6 so that fuel is supplied only through the first fuel injection valve 7.

When the judgement in the second step $S_2$ is that the actual engine accelerating rate is higher than the predetermined value, an asynchronous accelerating pulse $T_C$ is read in an eighth step $S_8$, and the pulse $T_C$ is supplied to the first fuel injection valve 7 in a ninth step $S_9$. The asynchronous accelerating pulse $T_C$ is generated irrespective of the phase of the engine rotation, whenever the actual engine accelerating rate becomes higher than the predetermined value, or in other words, when the control circuit 8 senses a relatively high engine acceleration. Therefore, the pulse $T_C$ is produced at a time different from the time when the synchronous pulses $T_P$, $T_S$ are produced. This is because, the aim is to obtain a quick response of the engine for accelerating operation. At the same time, the time $T_B$ is determined in accordance with the engine accelerating condition, and the additional amount of fuel required for the engine acceleration is injected.

Figure 4:
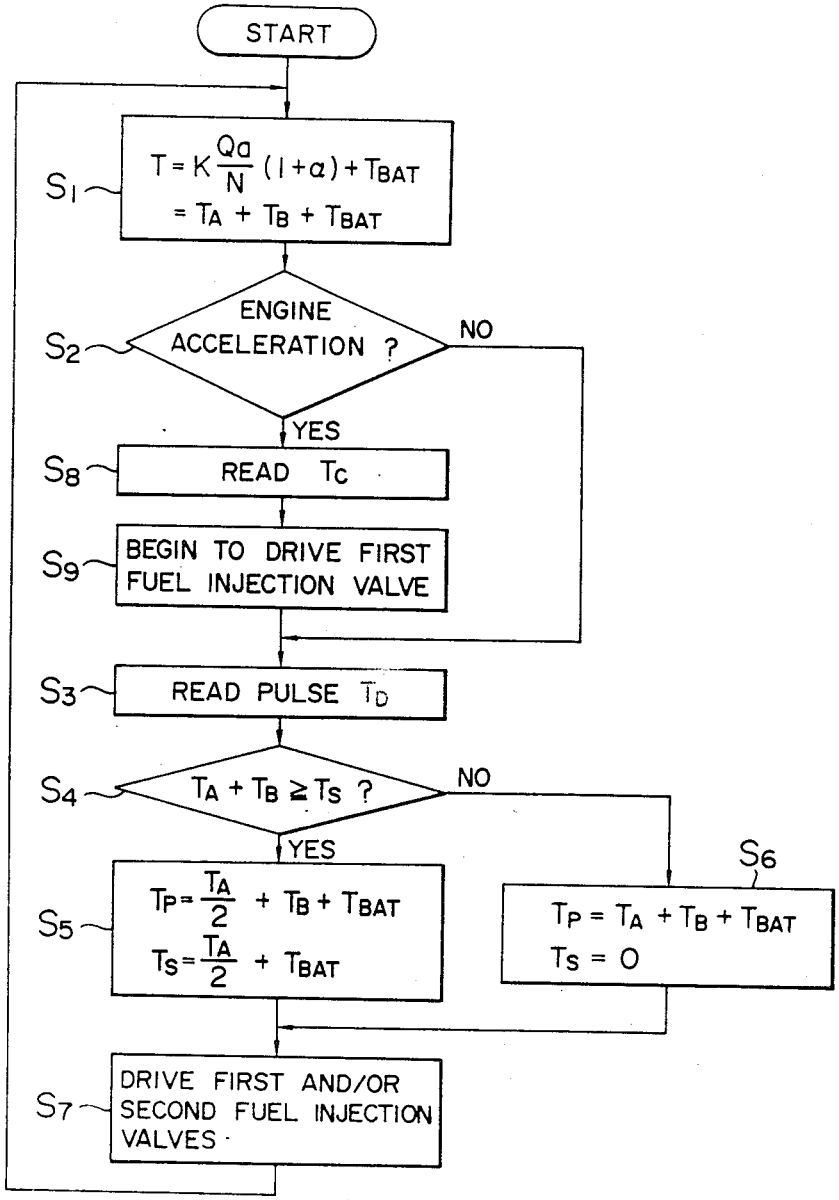
FIG. 4 is a flow chart showing another example of the fuel injection operations.
Figure 5:
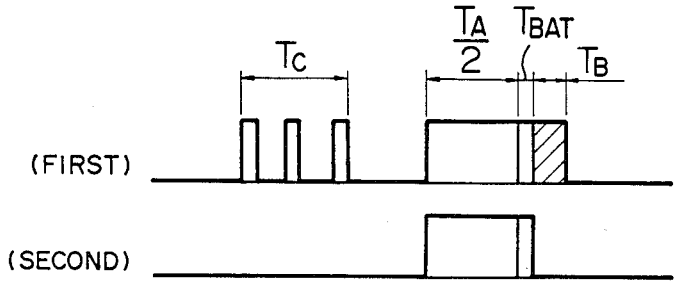
FIG. 5 is a chart showing another example of fuel injection pulses.
Figure 6:
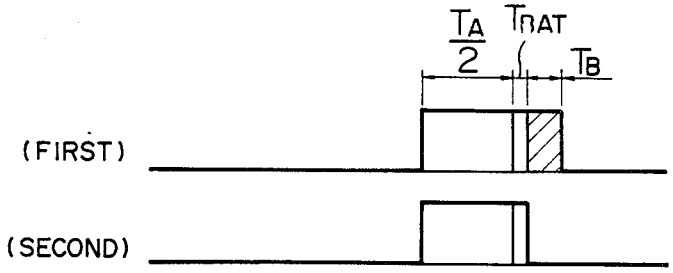
FIG. 6 is a chart showing another example of fuel injection pulses.

FIG. 4 is a flow chart showing another program of fuel injecting operation of the control circuit 8. This program is different from the aforementioned program explained with reference to FIG. 2 in that the pulse $T_P$ for the first fuel injection valve 7 is not equal to the pulse $T_S$ for the second fuel injection valve 6. More specifically, referring to the step $S_5$, the pulse $T_P$ to be supplied to the first fuel injection valve 7 is comprised of a half value of the time $T_A$, added with the time $T_B$ for engine acceleration and the ineffective time $T_{BAT}$, but the pulse $T_S$ to be supplied to the second fuel injection valve 6 does not include the increment $T_B$ for engine acceleration. An example of a pulse which is generated in the fuel injecting operation in accordance with this program is shown in FIG. 5. Alternatively, in the operation shown in FIGS. 2 and 4, the steps $S_2$, $S_8$, $S_9$ may be omitted, and the step $S_3$ may directly follow the step 1. In this case, as shown in FIG. 6, no asynchronous pulse will be generated, and the additional fuel supply for the engine acceleration is covered only by the time $T_B$.

Figure 7:
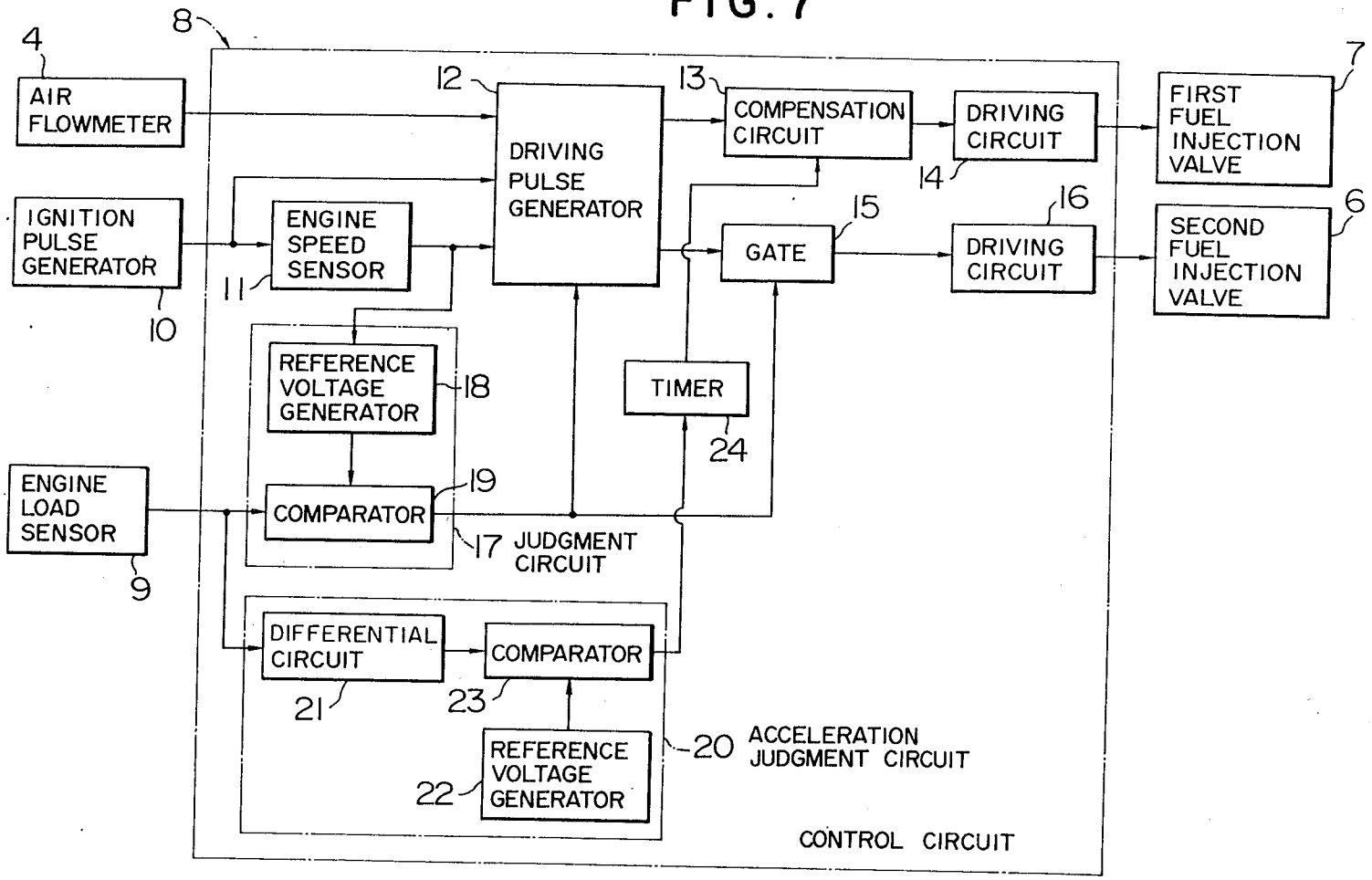
FIG. 7 is a block diagram showing the electrical control circuit adopted in the fuel injection device shown in FIG. 1.

The control circuit 8 may be constituted, for example, by electrical circuits as shown in FIG. 7. The control circuit 8 is provided with an engine speed detecting circuit 11 which receives ignition pulses from an ignition pulse generator 10 and calculates the rotating speed of the engine 1. There is provided a driving pulse generator 12 which generates driving pulses for driving the first and second fuel injection valves 7 and 6. The driving pulse generator 12 is connected with the engine speed detecting circuit 11 and an air flowmeter 4 so as to calculate the pulse width in proportion to the amount of air introduced in each revolution of the engine on the basis of outputs from the air flowmeter 4 and the engine speed detector 11, and generates a pulse with a calculated width in synchronization with the ignition pulse. A driving circuit 14 for the first fuel injection valve 7 is connected through a compensation circuit 13 for engine acceleration to an output of the driving pulse generator 12, whereby the first fuel injection valve 7 is driven throughout the engine operating range including the light load operation zone as well as the heavy load operation zone. With the other output end of the driving pulse generator 12, there is connected a driving circuit 16 for the second fuel injection valve 6 through a gate 15.

There is provided a judgement circuit 17 for judging whether the second fuel injection valve 6 should be operated. The judgement circuit 17 comprises a reference voltage generator 18 which receives outputs from the engine speed detector 11 and generates the reference voltage in proportion to the rotating speed of the engine 1, and a comparator 19 for comparing outputs representing the engine load from the engine load sensor 9 with the reference voltage generated by the generator 18. The comparator 19 produces a gate pulse for triggering the gate so that it passes the driving pulse from the driving pulse generator 12 when the output from the engine load sensor 9 is larger than the reference voltage. The output from the comparator 19 is also supplied to the driving pulse generator 12. The driving pulse generator 12 is provided with a compensator (not shown) for compensating the width of the driving pulse in accordance with the gate pulse in order to regulate the amount of fuel to be supplied to the engine 1 during operation of the second fuel injection valve 6.

The control circuit 8 is further provided with an acceleration judgment circuit 20 for judging whether or not the engine is in acceleration. The acceleration judgment circuit 20 is comprised of a differential circuit 21 which receives outputs from the engine load sensor 9 representing the degree of the opening of the throttle valve 5, a reference voltage generator 22 for generating a reference voltage, and a comparator 23 for comparing the outputs from the differential circuit 21 with the reference voltage. The comparator 23 produces an acceleration signal under engine acceleration where the rate of opening of the throttle valve 5 is above a predetermined value as represented by the reference voltage. The compensation circuit 13 regulates the driving pulse so that the amount of injected fuel is increased during engine acceleration. For instance, the output from the acceleration judgment circuit 20 is supplied via a timer 24 to the compensation circuit 13 so that the width of the driving pulse is increased for a certain time from generation of the acceleration signal.

In accordance with the control circuit 8, where the degree of the opening of the throttle valve 5 is varied as shown in FIG. 8(A), the driving pulse supplied to the driving circuit 14 for the first fuel injection valve 7 and the driving pulse supplied to the driving circuit 16 for the second fuel injection valve will change as shown in FIG. 8(B) and (C), respectively.

Describing the operation in more detail, during a stable light load engine operation $L_1$, a driving pulse 31 is generated by the driving pulse generator 12 and supplied only to the driving circuit 14 for the first fuel injection valve 7. The driving pulse 31 is generated in synchronism with the ignition pulse, and has the a width corresponding to the amount of fuel to be introduced in each revolution of the engine. Namely, the pulse 31 which is supplied to the driving circuit 14 is not compensated in the compensation circuit 13. The first fuel injection valve 7 is actuated to open when the driving pulse is applied thereto so that the amount of the injected fuel is regulated in accordance with the amount of the intake air in each revolution of the engine.

During the initial stage $L_2$ of the engine accelerating operation, the compensation circuit 13 for acceleration is operated by the acceleration signal which is supplied from the acceleration judgment circuit 20 through the timer 24 to the compensation circuit 13 so that a compensated driving pulse 32 to be supplied to the driving circuit 14 has a width larger than the width of the driving pulse 31. As a result, during the initial stage $L_2$ of the engine accelerating operation, the first fuel injection valve 7 is controlled so that the amount of fuel injected thereby is increased. Further, since the first fuel injection valve 7 is positioned close to the engine 1, the additional amount of fuel injected therefrom is rapidly introduced into the combustion chamber 19 of the engine 1. Accordingly, it is possible to provide a quick supply of additional fuel for the engine acceleration to prevent the output power of the engine from falling off during the initial stage $L_2$ of engine accelerating operation.

During heavy load engine operation H, the gate pulse from the judgment circuit 17 triggers the gate 15 so the gate 15 allows the driving pulse 33' to pass from the driving pulse generator 12 to the driving circuit 16 for the second fuel injection valve 6. The driving pulse 33' has the same width as the driving pulse 33 which is supplied to the driving circuit 14 for the first fuel injection valve 7. Accordingly, both the first and second fuel injection valves 7 and 6 are operated. In this case, the driving pulse generator 12 also receives the gate pulse, and regulates the width of the driving pulses 33 and 33' in accordance with the gate pulse so that the total amount of fuel injected by both the fuel injection valves 7 and 6 is controlled in response to the amount of the intake air in each revolution of the engine 1.

Figure 8:
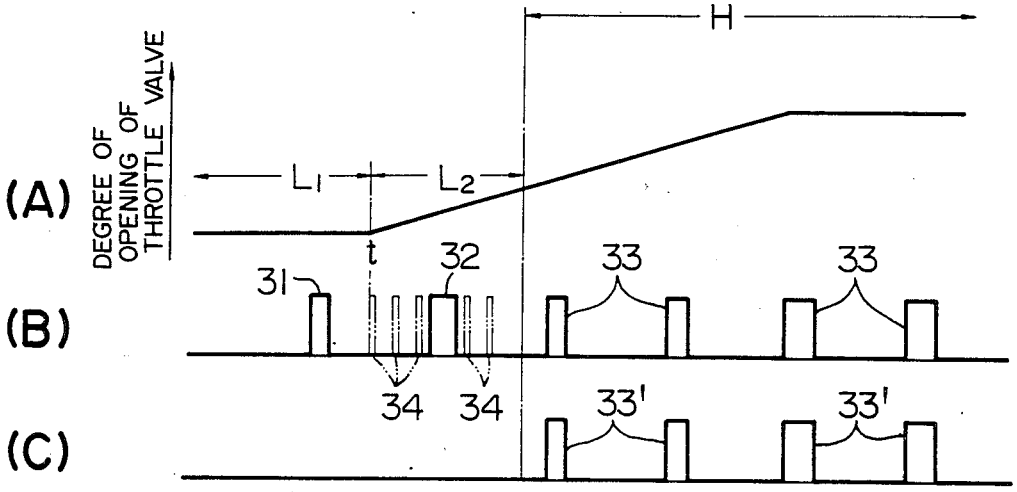
FIG. 8 is a chart showing another example of fuel injection pulses.

In the above embodiment, the compensation circuit 13 compensates the width of the driving pulse 32 which is produced in synchronization with the ignition pulse, and alternatively or in addition to this, the compensation circuit 13 may produce a certain number of asynchronous driving pulses 34 from the starting point of engine acceleration as shown by phantom lines in FIG. 8.

Figure 9:
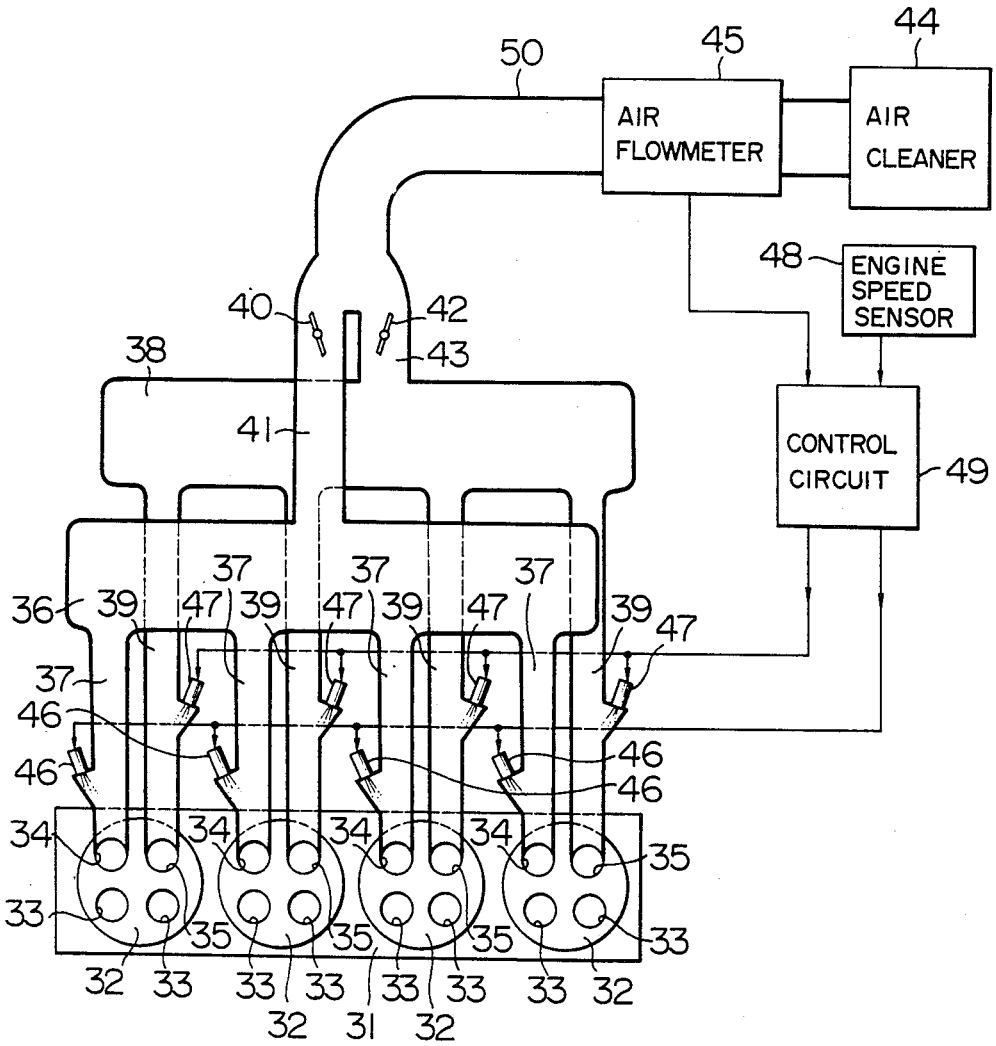
FIG. 9 is a diagrammatical view of a fuel injection device in accordance with a second embodiment of the present invention.

Referring to FIG. 9, there is shown a second embodiment in which the present invention is applied to a four-cylindered engine. Each of four combustion chambers 32 formed in cylinder block 31 is formed with two exhaust ports 33, a primary intake port 34 and a secondary intake port 35. There are provided primary intake branch passages 37 which are connected with the primary intake ports 34. The branch passages 37 are branched from an inlet manifold pipe 36 which functions as a primary surge tank. There are further provided secondary intake branch passages 39 which are connected with the secondary intake ports 35. The secondary intake branch passages 39 are branched from an intake manifold pipe 38 which functions as a secondary surge tank. The primary intake branch passages 37 are connected with a primary intake passage 41 having a primary throttle valve 40 through the manifold pipe 36. The secondary intake branch passages 39 are connected with a secondary intake passage 43 having a secondary throttle valve 42 through the manifold pipe 38. Furthermore, the intake passages 41, 43 are connected with a main intake passage 50 provided with an air cleaner 44 and an air flowmeter 45. The secondary throttle valve 42 begins to open when the primary throttle valve 40 is substantially fully opened, so as to permit the intake air for heavy load engine operation to pass through the secondary intake passage 43.

The primary intake branch passages 37 are respectively provided with primary fuel injection valves 46 which are positioned relatively close to the combustion chambers 32. The secondary intake branch passages 39 are respectively provided with secondary fuel injection valves 47 which are located further from the combustion chambers 32 than the primary fuel injection valves 46. The engine is provided with an engine speed sensor 48 which senses the rotating speed of the engine. A control circuit 49 is connected with the air flowmeter 45 and the engine speed sensor 48 to receive signals therefrom. The control circuit 49 may have the same construction and function as the control circuit 8 in the embodiment as shown in FIG. 1. The control circuit 49 calculates the amount of fuel to be supplied to the engine in accordance with engine operating conditions on the basis of input signals, and operates the primary and secondary fuel injection valves 46 and 47 in accordance with the calculated results.

Figure 10:
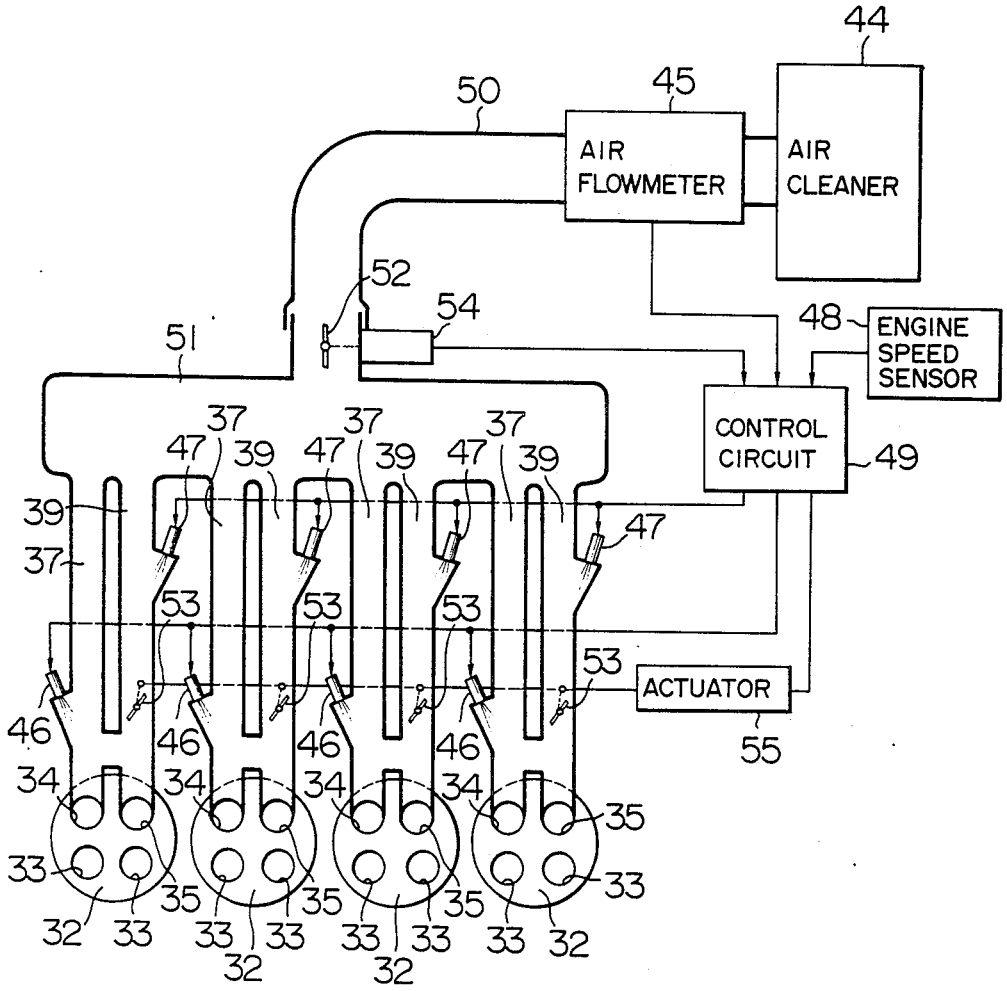
FIG. 10 is a diagrammatical view of a fuel injection device in accordance with a third embodiment of the present invention; and, FIG. 11 is a diagrammatical view of a fuel injection device in accordance with a fourth embodiment of the present invention.

Referring to FIG. 10, a third embodiment of the present invention is shown. In the third embodiment, the primary and secondary intake branch passages 37 and 39 which are connected with the respective intake ports 34, 35 are connected with a common surge tank 51. The main intake passage 50 is connected with the surge tank 51. A main throttle valve 52 is provided in the main intake passage 50. In the secondary intake branch passages 39 there are provided valves 53 downstream of the secondary fuel injection valves 47. The main throttle valve 52 is provided with a sensor 54 which senses the degree of opening thereof. The control circuit 49 receives outputs from the sensor 54. The control circuit 49 operates the primary and secondary fuel injection valves 46 and 47 in response to engine operating conditions as in the above-mentioned embodiments, and controls an actuator 55 for the valves 53 in accordance with the degree of the opening of the main throttle valve 52 and the engine speed so that the valves 53 are opened during heavy load and high speed operation of the engine. In this embodiment, since the valves 53 are positioned downstream of the secondary fuel injection valves 47, liquid fuel on the inner surfaces of the second intake branch passage 39 will not be vaporized when the valves 53 are rapidly closed for deceleration. Therefore, the air-fuel mixture will not become too rich.

Figure 11:
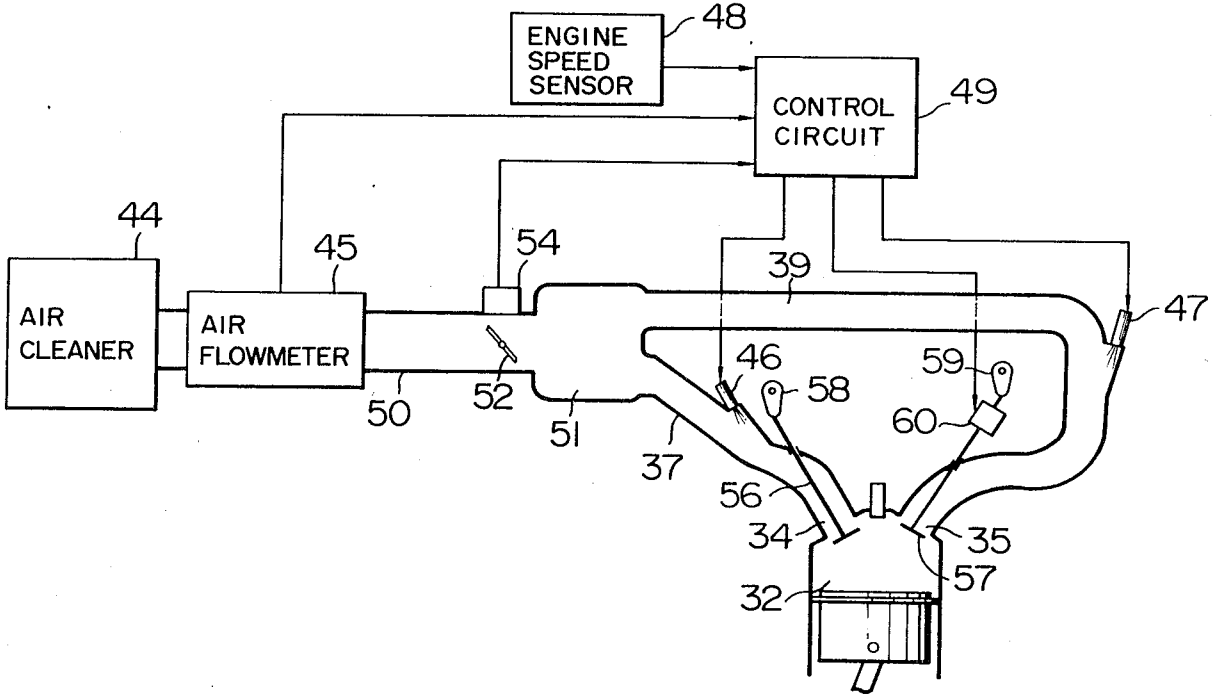

In the third embodiment, the secondary intake passage is controlled by the valves provided in the secondary intake branch passages, and alternatively, the control of the secondary intake passage may be carried out by valve selectors which control the operation of secondary intake valves for opening or closing the secondary intake port. One example of such arrangement will be described with reference to FIG. 11 as a fourth embodiment of the present invention.

In the fourth embodiment, the primary and secondary intake ports 34 and 35 formed on the combustion chamber 32 are provided with primary and secondary intake valves 56, 57. The intake valves 56, 57 are controlled by cams 58, 99 so that the valves are alternately opened or closed. The second intake valve 57 is provided with a valve selector 60 which is connected with the control circuit 49. The valve selector 30 receives outputs from the control circuit 49 and operates the secondary intake valve 57 by transmitting the movement of the cam 59 to the valve 57 only during heavy load and high speed operation of the engine.

The invention has thus been shown and described with reference to specific embodiments, however, it should be noted that the invention is in no way limited to the details of the illustrated structures, but changes and modifications may be made without departing from the scope of the appended claims.

What is claimed is:

1. A fuel injection system for an engine having combustion chamber means and intake passage means leading to said combustion chamber means, said fuel injection system comprising first and second fuel injection valve means located in said intake passage means so that one of said fuel injection valve means is closer to said combustion chamber means than the other, control means for producing first synchronized fuel injection pulses which are produced at timings synchronized with engine rotation throughout an engine operating range including light load engine operation and heavy load engine operation and adapted to be applied to said first fuel injection valve means to actuate the same, and for producing second synchronized fuel injection pulses which are produced at timings synchronized with the engine rotation only during heavy load engine operation and adapted to be applied to said second fuel injection valve means to actuate the same, said first and second synchronized fuel injection pulses providing a basic fuel supply quantity which is determined in accordance with an engine operating condition, acceleration detecting means for detecting a demand for acceleration of the engine, said control means including means for producing non-synchronized fuel injection pulses when a demand for engine acceleration is detected by the acceleration detecting means, said non-synchronized fuel injection pulses applied to said fuel injection valve means closer to said combustion chamber means for providing a supply of fuel in addition to said basic fuel quantity at timings not synchronized with the engine rotation, and means for increasing widths of said first and second synchronized fuel injection pulses when demand for engine acceleration is detected and for providing additional fuel at timings synchronized with the engine rotation.

2. A fuel injection system in accordance with claim 1 in which said first fuel injection valve means is located downstream of said second fuel injection valve means relative to said intake passage means.

3. A fuel injection system in accordance with claim 1 in which said intake passage means includes two intake passages leading to the same combustion chamber means, one of said first and said second fuel injection valve means being located on one of said two intake passages, and the other of said fuel injection valve means being located on the other intake passage.

4. A fuel injection system in accordance with claim 3 in which said one of the two intake passages is a first intake passage for introducing air throughout a full range of engine operation, and the other intake passage is a second intake passage for introducing air only during heavy load engine operation, said first and second fuel injection means being provided on said first and second intake passages, respectively.

5. A fuel injection system in accordance with claim 4 in which said first and second intake passages are provided with surge tank means upstream of said fuel injection valve means.

6. A fuel injection system in accordance with claim 3 in which said control means includes means for periodically acuating said first and second fuel injection valve means synchronously with rotation of the engine during engine operation when engine acceleration demand is below a predetermined value, and means for actuating the first fuel injection valve means asynchronously with the rotation of the engine to increase the amount of fuel injected thereby during engine acceleration when engine acceleration demand is above said predetermined value.

7. A fuel injection system in accordance with claim 3 in which valve means is provided downstream of said second fuel injection valve means for closing during engine deceleration the other intake passage provided with said second fuel injection valve means.

8. A fuel injection system in accordance with claim 1 in which said intake passage means includes a common intake passage provided with both said first and said second fuel injection valve means.

9. A fuel injection system in accordance with claim 1 in which said control means includes means for actuating said first and second fuel injection valve means periodically in synchronism with rotation of the engine during engine operation when engine acceleration demand is below a predetermined level, and for actuating the first fuel injection valve means asynchronously with the rotation of the engine to provide an additional supply of the fuel during engine acceleration when engine acceleration demand is above said predetermined value.

10. A fuel injection system for an internal combustion engine having at least one combustion chamber and a plurality of intake passages leading to said combustion chamber, said fuel injection system comprising first fuel injection valve means provided on one of said plurality of intake passages, second fuel injection valve means provided on the other of said plurality of intake passage, said first fuel injection valve means being located close to said combustion chamber, said second fuel injection valve means being located further from said combustion chamber than said first fuel injection valve means, control means for producing first synchronized fuel injection pulses which are produced at timings synchronized with engine rotation throughout an engine operating range including light load engine operation and heavy load engine operation and adapted to be applied to said first fuel injection valve means to actuate the same, and for producing second synchronized fuel injection pulses which are produced at timings synchronized with the engine rotation only during heavy load engine operation and adapted to be applied to said second fuel injection valve means to actuate the same, said first and second synchronized fuel injection pulses providing a basic fuel supply quantity which is determined in accordance with an engine operating condition, acceleration detecting means for detecting a demand for acceleration of the engine, said control means including means for producing non-synchronized fuel injection pulses when demand for engine acceleration is detected by the acceleration detecting means, said non-synchronized fuel injection pulses applied to said first fuel injection valve means for providing a supply of fuel in addition to said basic fuel quantity at timings not synchronized with the engine rotation.

11. A fuel injection system in accordance with claim 10 including valve means for permitting said one of said plurality of intake passage means on which said first fuel injection valve means is provided to pass intake air throughout the engine operating range, and for permitting the other of said plurality of intake passage means on which said second fuel injection valve means is provided to pass intake air only during heavy load engine operation.

12. A fuel injection system in accordance with claim 11 in which said first and second intake passages are provided with surge tank means upstream of said fuel injection valve means.

13. A fuel injection system in accordance with claim 12 in which said surge tank means includes two surge tanks which are independently provided on respective ones of said intake passage means.

14. A fuel injection system in accordance with claim 4 in which said first fuel injection valve means is located closer to said combustion chamber means than said second fuel injection valve means.

15. A fuel injection system in accordance with claim 10 in which said control means further includes means for increasing widths of said first and second synchronized fuel injection pulses when demand for acceleration is detected and for providing additional fuel at timings synchronized with the engine rotation.

16. A fuel injection system in accordance with claim 10 in which said control means includes means for producing the second synchronized fuel injection pulses when the basic fuel supply quantity is above a predetermined value.

17. A fuel injection system in accordance with claim 1 in which said control means includes means for producing the second synchronized fuel injection pulses when the basic fuel supply quantity is above a predetermined value.

18. A fuel injection system in accordance with claim 10 in which the acceleration detecting means includes means for sensing the rate of opening of a throttle valve, means for providing a reference throttle valve opening rate, and comparator means for comparing the sensed rate with the reference rate and for providing a signal when the sensed throttle opening rate is greater than the reference throttle opening rate.

19. A fuel injection system in accordance with claim 1 in which the acceleration detecting means includes means for sensing the rate of opening of a throttle valve, means for providing a reference throttle valve opening rate, and comparator means for comparing the sensed rate with the reference rate and for providing a signal when the sensed throttle opening rate is greater than the reference throttle opening rate.

* * * * *